US009895790B2

(12) United States Patent
Fiore

(10) Patent No.: US 9,895,790 B2
(45) Date of Patent: Feb. 20, 2018

(54) MULTI-ABRASIVE TOOL

(75) Inventor: Nicola Fiore, Parabiago (IT)

(73) Assignee: REN S.r.l., Milan (IT)

( * ) Notice: Subject to any disclaimer, the term of this patent is extended or adjusted under 35 U.S.C. 154(b) by 823 days.

(21) Appl. No.: 14/117,695

(22) PCT Filed: Jul. 7, 2011

(86) PCT No.: PCT/IT2011/000232
§ 371 (c)(1),
(2), (4) Date: Feb. 19, 2014

(87) PCT Pub. No.: WO2012/157006
PCT Pub. Date: Nov. 22, 2012

(65) Prior Publication Data

US 2014/0154961 A1 Jun. 5, 2014

(30) Foreign Application Priority Data

May 16, 2011 (IT) ..... MI2011A0850

(51) Int. Cl.
*B24D 7/14* (2006.01)
*B24D 5/14* (2006.01)
(Continued)

(52) U.S. Cl.
CPC ..... *B24D 7/14* (2013.01); *B24D 5/14* (2013.01); *B24D 7/06* (2013.01); *B24D 11/04* (2013.01)

(58) Field of Classification Search
CPC ..... B24D 7/14; B24D 11/04
(Continued)

(56) References Cited

U.S. PATENT DOCUMENTS 2,451,295 A * 10/1948 Metzger ..... B24D 7/14 451/461
2,496,352 A * 2/1950 Metzger ..... B24D 7/14 451/345
(Continued)

FOREIGN PATENT DOCUMENTS

EP 1 813 387 A1 8/2007
GB 1088013 A 10/1967
(Continued)

*Primary Examiner* — Robert Rose
(74) *Attorney, Agent, or Firm* — Blank Rome LLP

(57) ABSTRACT

A multi-abrasive tool is constituted by a support on which abrasive elements are present. Such abrasive elements are arranged in a manner so as to form one or more paths along which the successive abrasive elements have grain size sequentially increasing or decreasing by an arbitrary quantity when passing from on element to the next. Such principle gives rise to abrasive tools with different conformation both for polishing machines and for grindstones. For roto-orbital and planetary polishing machines, and optionally orbital, such support is circular and the grain sequence is circumferential, or radial, or in both directions. A first tool is constituted by contiguous (or non-contiguous) circular rings, that are differently abrasive. A second tool comprises differently abrasive elements arranged along the circular peripheral edge. A third tool comprises differently abrasive elements arranged along a spiral path of 360° starting from the edge. A fourth tool comprises two 180° spiral paths with reversed roughness sequences. A fourth tool comprises pairs of differently abrasive small cylinders fixed to a plate on concentric circumferences. A fifth tool is obtained directly on the plate of the polishing machine by means of reliefs and spacers for fixing differently abrasive sectors. For linear polishing machines, the abrasive support is a belt along which differently abrasive rectangular or oblique zones follow each other. For alternative polishing machines, the
(Continued)

abrasive support is a plate shaped like the aforesaid belt. For tools to use with grindstones, the multi-abrasive element has a cylindrical rotation symmetry, or conical with rounded tip, or spherical symmetry.

5 Claims, 12 Drawing Sheets

(51) Int. Cl.
*B24D 7/06* (2006.01)
*B24D 11/04* (2006.01)

(58) Field of Classification Search
USPC ..... 451/58, 359, 353, 548, 551, 344, 350
See application file for complete search history.

(56) References Cited

U.S. PATENT DOCUMENTS

| | | | | |
|---|---|---|---|---|
| 6,926,583 | B2 * | 8/2005 | Nussbaumer ..... | B24D 7/12 451/5 |
| 2004/0048552 | A1 | 3/2004 | Kisbøll et al. | |
| 2004/0048557 | A1 | 3/2004 | Nabeya | |

FOREIGN PATENT DOCUMENTS

| | | | |
|---|---|---|---|
| JP | 5-269671 | A | 10/1993 |
| JP | 2008-100289 | A | 5/2008 |
| SU | 608645 | A1 | 5/1978 |

* cited by examiner

KNOWN ART

KNOWN ART

KNOWN ART

KNOWN ART

MULTI-ABRASIVE TOOL

FIELD OF APPLICATION OF THE INVENTION

The present invention is applied to the manufacture of abrasive tools for the polishing of surfaces of various materials with rough surfaces, such as for example: stone, concrete, metal, wood, and more precisely to a multi-abrasive tool. The invention is applicable to the development of planar abrasive tools for polishing machines of any type, as well as for tools with cylindrical symmetry for grindstones. Polishing machines that could potentially use the abrasive tool of the present invention are, for example, those which use an abrasive paper belt rotating on two axes; those which use an abrasive vibrating in a straight line; those with abrasive single-disc with simple rotation; orbital polishing machines which use an abrasive to which an orbital vibratory movement is imparted with respect to its own axis (which does not rotate on itself); roto-orbital polishing machines in which, unlike the orbital machines, the axis also rotates on itself; planetary polishing machines in which multiple circular tools roll around a circumference which rotates on itself. The grindstones that could potentially use the abrasive tool of the present invention are, for example, bench grinders, angle grinders (also called "flexible"), and board grinders with mandrel for tools equipped with shank.

REVIEW OF THE PRIOR ART

The roughness or finish grade of a surface can be indicated by the root mean square (RMS), in μm, between the measurements of the height of the actual surface with respect to a ideal smooth surface. Polishing, or levigation, is a mechanical finishing process for materials adapted to eliminate, or at least reduce, the surface roughness by means of abrasives of various nature in accordance with the material to be polished or process used.

The abrasives are characterized by their hardness, by their low fragility, and by the fact that they have crystalline nature. Well-known natural abrasives include: diamond, corundum, quartz, silica, pumice, sandstone, emery, garnet, etc. Artificial abrasives include: aluminum oxides, chromium oxides, iron oxides, boron nitride, silicon carbide, glass, boron carbide, etc. In manufacturing abrasive tools, a material having the above properties is first ground until a predetermined grain size is attained, and the powder obtained in such a manner can be differently treated, for example: mixed with suitable binder and inserted into molds of the desired form, in order to then be heated in the oven; mixed with resins and applied to planar substrates (flexible or flat discs); sintered in the shape of the tool or in that of elements to be applied to a support plate of the same; electrochemically laid down on a substrate of suitable form, as occurs for the diamond powder in a substrate of brass, aluminum, nickel, etc. During abrasion, chips and powders are produced, coming from the abrasive and from the scraped material. The friction developed by the abrasion also produces a lot of heat, which facilitates undesired chemical reactions. In the polishing of hard materials, one therefore uses water-based lubricants, like mixtures of water and mineral oils which diminish the heat and remove the chips and powders. In the polishing of soft materials, the obstruction of the abrasive, i.e. the covering of the abrasive surface by the scraped material to form a layer which prevents the contact with the abrasive granules and the material being worked, is avoided by using lubricants with waxes and solid fats. The finishing grade of the surface being polished strictly depends on the grain of the abrasive, i.e. on the average diameter of its particles or grains. The grains of the abrasives are classified by means of screening, and assume a recognition number which corresponds to the number of mesh per linear inch of such sieve, which retains most of the grain in the sequential fractionated grain size analysis of a sample thereof. The classification value of the grain is therefore in inverse proportion to the average diameter of the grains; thus, the higher the identification value of the grain, the finer are the grains. The tables that are by now universally accepted for controlling the abrasive grains of artificial corundum and silicon carbide, in the series that ranges from grain 8 up to and including 240, are defined in the document: "Simplified Practice Recommendation 118-50", published by the American Department of Commerce and fully adopted by UNI in Table 3898 of April 1957. Subsequent developments of such tables take under considerations grain values expressed in thousands, relative to much finer grains selected by means of sedimentation. The abrasive grains used in the manufacture of flexible abrasives, such as abrasive papers, are collected in the file: "Commercial Standard CS217-59" once again published by the American Department of Commerce, and also adopted by the Federation of European Manufacturers of Abrasive Products (FEPA).

Abrasives classified as stated above are applied to the tools used in the polishing machines mentioned in the introduction, both portable and bench machines. The first, generally manual, are available on the market in small, medium and large size. In the polishing of floors, they are capable of smoothing the unevenness due to the projection between one sheet and the other after the setting, of restoring the horizontality lost due to possible surface deteriorations or adjustments, or lowering the surface until the desired final design is attained.

The bench polishing machines include both the small machines for usually artisanal jobs, and the large automated industrial machines, constituted by multiple autonomously motorized units arranged in cascade, each having a head equipped with one or more abrasive tools of the same grain, the size of the grains gradually decreasing from one head to the next. In these large machines, the rough sheet is laid on a conveyor belt which carries it under each head, starting with that with the coarsest abrasive, in order to be gradually smoothed and polished.

FIG. 1 shows a typical portable polishing machine of planetary type with weight greater than 300 Kg, driven by a vertically-arranged, 10 HP three-phase electric motor 2, whose drive shaft is coupled with a gear mechanism of planetary type included in a tool drive head 3, shown in FIG. 2. The head 3 is enclosed in a circular casing 4 bordered by a squeegee-like rubber band 5. The motor-planetary body is anchored in an overturnable manner to a frame 6 equipped with two wheels 7 and a handle 8 with control buttons. The frame 6 hosts a tank 9 of the water for cooling and lubricating the abrasives, and a case 10 for the electrical components. The head 3 comprises three plates 11, 12, 13 rotating in an epicycloidal manner at a speed which can be varied from 300 to 1300 rpm (revolutions per minute). A quick coupling system allows mounting the more suitable abrasive tools 14 on the single plates 11, 12, 13. The possible applications of this machine are the following: removal of irregularities on concrete; removal of resins and glues; preparation of surfaces; shining of marbles and granites; mirror finishing of concrete, etc.

The subsequent FIGS. 3-9 show a limited subset of the immense world of abrasive tools mountable on the plates 11, 12, 13 of the head 3, or usable in the polishing machines of another type. Said tools generally assume the form of a rigid circular plate constituted by a substrate of material capable binding the abrasive present in reliefs of particular geometry on the work face; or of a flexible disc fixed to a backing pad by means of adhesive or Velcro. Independent of the type of abrasive selected, the configuration of the same on the support disc or plate will have to be symmetric both in form and weight, so as to maintain the head of the polishing machine perfectly balanced during rotation, and thus without damaging transverse oscillations due to the unbalancing of the rotating masses. Such characteristic is respected in the tools that can be found on the market. Also the connections of the abrasive tools to the head of the polishing machine can be of quite different type, such as: pressure, screw, spiral, bayonet, pin, magnetic, etc.

In FIG. 3, an abrasive disc 16 is shown that can have various thickness, for example from 4 to 13 mm, constituted by fine-grain diamond powder incorporated in a resinoid binding matrix. The anchorage to the rotating plate of the polishing machine can make use of a direct quick coupling device, or of a dragging disc (backing pad) anchored to the Velcro present on the rear face of the disc 16. The abrasive face has a series of oblique teeth 17 forming a circular ring starting from the external edge. This tool was designed for obtaining maximum duration and optimal finish on marble floors. The tool is widely used and appears in various catalogues, it is for example comprised between the tools which appear in the catalogue of Meneghini & Bonfanti (La Genovese) with the following use possibilities:

- marble, available in the following grain size of ASTM scale: 30/50/120/220/400/600/800 mesh. For a good finish grade, it is sufficient to employ up to 400 grain, while one can continue with the two subsequent grains to obtain an extra finish.
- granite, in various mixtures for fine grains in the following grain size: 30/50/150/300/500/1000/2000/4000 mesh. Recommended the use of the complete sequence except on some particularly easy granites, where it is possible to stop at 2000 grain, then shining with powders and felt pads.

FIG. 4 shows an abrasive disc 18 which differs from the preceding due to the fact that it is empty at the center, and due to a fragmentation of the teeth 19 by means of concentric circular grooves. The discs 18 are very flexible and thus adapted to shine concave surfaces.

FIG. 5 shows an abrasive tool 20 comprising a plate 21 from which four short diamond abrasive cylinders 22 project, of the same grain size and regularly spaced along the edge. In the center of the plate, a hole 23 is present for the application via three screws 24 to a dragging disc at the back. The extremely aggressive tool is usable for removing resins and paints and for polishing concrete. The plate 21 can be plastic or metal and the diamond cylinders 22 glued thereto; or plate and cylinders can be obtained in a single forming process of resinoid and abrasive material.

FIG. 6 shows an abrasive tool 26 made of silicon carbide with synthetic magnesic binder, constituted by a very thick disc perforated at the center and deeply radially grooved to form six circular sectors 27. The tool is suitable for removing mastic or polishing very abrasive floors where the resinoid diamond discs might be inconvenient. They are also used for grinding industrial formworks.

FIG. 7 shows an abrasive tool 28 constituted by a cylinder 29 with rounded edge perforated at the center, made of the same material of the preceding tool and with the same use possibilities.

FIG. 8 shows an abrasive tool 30 constituted by a circular plate 31 made of resinoid material perforated at the center, from which nearly parallelepiped, diamond abrasive blocks 32 project, that are regularly spaced along the edge of the plate. This tools is particularly recommended for polishing hard, aged concrete.

The subsequent FIGS. 9-12 show several examples of abrasive tools used by a single-disc polishing machine. The tool is constituted by the set of abrasive elements mounted on a support, which often coincides with the circular plate itself of the polishing machine, suitable shaped on the basis of the form of the abrasive elements to be mounted by means of fitting or gluing with mastic. The abrasive elements can have different shape, for example: Cassani type; "virgole Genovesi" type; Munchen, Frankfurt, Fickert, Tibaud, Pedrini prism-shaped segments type, etc. With regard to the connections of the plate to the rotating head of the polishing machine, a big nut is generally provided, or quick connection mechanisms similar to those used in satellite polishing machines. Particular care must be given in the positioning of the abrasive elements on the plate, in order to avoid the unbalancing of the plate during rotation.

FIG. 9 shows the front face of a backing pad 33 equipped with a series of concentric circular grooves for the fitting of small-size abrasives. Alternatively, it is possible to glue a flexible abrasive disc or a rigid abrasive cylinder. In FIG. 10, the rear face is shown of the backing pad of FIG. 9, at the center of which a large nut 34 is visible for the screw connection to the rotating plate of a single-disc polishing machine. The backing pad 33 thus acts as an intermediate support. FIGS. 11, 12, 13 show three abrasive discs 35*a*, 35*b*, 35*c*, each one having an its own grain size, and the three grains with decreasing size, separately applicable to the backing pad 33 for the execution of three passages of the polishing process.

FIG. 14 shows a circular plate 36 of a single-disc polishing machine from which three abrasive sectors 37 project of Frankfurt type, arranged at 120°. In the specific case, the sectors 37 are made of silicon carbide granules bound with magnesite having the shape of a trapezoidal solid comprising a large central canal that is curved and tapered for unloading the chips. Three connections are fixed to the plate 36, which are constituted by two strong lateral shoulders 38 joined by a base abutted on the plate 36. The shoulders 38 are screwed to the plate 36 and, with the base, constitute a seat for the prism-shaped sector 37. At the junction of the shoulders 38 with the base, there are two respective grooves acting as a guide and fitting for the Frankfurt abrasive sector 37.

FIG. 15 shows a plate 40 whose circular edge 41 is raised. Triangular reliefs 42 are anchored to the plate 40, regularly spaced in a circle close to the edge 41 and projecting almost to the height of the same. The reliefs 42 are oriented in a manner so as to form, with the edge 41, three seats spaced 120° for fitting three abrasive sectors of Cassani 43 type with lunette form projecting from the edge 41, made of silicon carbide granules bonded with magnesite or cement.

FIG. 16 shows a circular plate 44 with three curved notches 45 spaced 120° starting from the external edge, from which the same number of abrasive sectors 46 project to form "virgola Genovese" made of the same material as the Cassani abrasive sectors. Three other rectangular notches 47 spaced with respect to the preceding ones are available for further abrasives.

The tools shown in the figures described above allow the polishing of marbles, granites and concrete in general.

Outlining the Technical Problem

In the process of polishing surfaces (and more generally in the grinding process), the efficiency of abrasive tools in removing and above all the obtainable surface quality is considerable determined by the average size of the hard material grain. The largest grains allow obtaining a greater removal efficiency, but negatively affect the quality of the surface finish, while the finest grains allow obtaining surfaces of improved quality, but with lower removal efficiency. Such opposite results require carrying out rough-shaping operations and finishing operations. Currently, the polishing process of a surface comprises the following steps in sequence: smoothing, rough-shaping, closure of possible lines and pores, and finishing; followed by the shining step. Each step requires a different abrasive and thus a different type. The surface to be polished can be that of floors of many different materials, spaces with raw cement, rough slabs of stone from quarries that were previously briefly leveled/smoothed, or calendered metal slabs, or wood parquet. In the manual polishing machines, it is the machine itself to be moved, and since the polishing process requires the aforesaid sequential steps, carried out with increasingly finer grain abrasives, the overall duration of the process will increase the dead times necessary for changing the abrasive tools. For an approximate calculation of the overall time of the polishing process, one must take under consideration that, starting from a floor that has just been laid, for nearly all the material types such as: marble, granite, "seminati", agglomerates, etc. from the rough-shaping to the preparing for the shining, the surface will be subjected to about a ten steps with increasingly finer grain abrasives. The following table is indicative of the necessary steps in a polishing process of flat marble or granite surfaces, with the exclusion of the shining steps generally executed with fine powders passed with the aid of felt backing pads.

TABLE 1

Single-abrasive tools for a single-disc polishing machine

| Step No. | Step description | Tool type | Abrasive type | Grain classification, Mesh ASTM |
|---|---|---|---|---|
| 1 | Rough-shaping | Plate with fittings for segment tools (abrasive sectors) | Diamond, nickel binder | 16 (1200 μm) |
| 2 | Same | Same | Same | 30 (590 μm) |
| 3 | Same | Same | Diamond, brass binder | 45 (350 μm) |
| 4 | Same | Same | Same | 60 (250 μm) |
| 5 | Refining | Same | Diamond, resinoid binder | 120 (125 μm) |
| 6 | Refining | Same | Same | 230 (62 μm) |
| 7 | Refining | Same | Same | 400 (37 μm) |
| 8 | Refining | Same | Same | 800 (≈18 μm) |
| 9 | Refining | Same | Same | 1250 (10 μm) |
| 10 | Refining | Same | Same | 3500 (≈4 μm) |

Each step can require several passages intersecting on the same area. The operator, for each change of abrasive, will have to turn off the machine, clean the worked surface and convey the liquid waste into suitable container drums or directly into the discharge wells, dry the worked surface, check the executed work, mount the abrasive tools for the subsequent step, and finally start again. With such specifications, a polisher equipped with a conventional single-disc or planetary polishing machine will polish and shine on average 15 $m^2$ in eight hours of work per day, at full operation level, including the stucco work. If it is necessary to polish a greater surface area, and if one has available a "giant" manual polishing machine, the daily average can increase to 60-80 $m^2$, the work of collection of the liquid waste having less effect on the average; such waste can be thrust by the rubberized band of the head in zones of the floor still to be worked, and here they can be dried and then disposed of.

To the average times mentioned above, it will be necessary to add the time for the perimeter polishing, generally executed with small grinders equipped with abrasive paper that is changed each time, decreasing from large grain to fine grain. The perimeter polishing is indispensable when the floors are delimited by walls, since the head of the polishing machine has lateral bulk that prevents the rotating tools to be pushed against the wall. Consequently, along the entire perimeter of the room, a strip is formed in which the floor maintains a difference in height.

The conventional grinding process also requires a change of tools with decreasing grain size, and thus has the drawbacks of the polishing, although to a lesser extent.

Object of the Invention

Object of the present invention is to reduce the duration of the polishing process.

Another object of the present invention is to reduce the duration of the grinding process.

Another object of the invention is to reduce the number of abrasive tools necessary in the aforesaid processes.

Another object of the invention is to improving the polishing close to the walls.

Another object of the invention is to make the polishing and grinding processes more economical.

SUMMARY OF THE INVENTION

In order to attain such objects, the present invention has an abrasive tool as object, in which according to the invention it includes on the work face at least two abrasive elements with different roughness, as described in claim 1.

The invention described in its most general form lends itself to different embodiments, and further characteristics of the present invention, in its various embodiments deemed innovative, are described in the dependent claims.

In a preferred embodiment, the work face includes more than two abrasive elements with different roughness arranged in a manner so as to form, along at least one path between adjacent abrasive elements, a sequence that is ordered by increasing or decreasing roughness values.

Advantageously, the invention reduces the number of abrasive "passages" on the surface to be polished or ground with respect to the use of conventional tools, in which at each "passage" it is necessary to substitute the tool with another one with finer grain, i.e. with lower roughness, consequently also reducing the dead times for the tool change. In polishing, it in fact results possible to execute the 10 steps of Table 1 with a single innovative tool, or more conservatively, with two tools of which a first is for the rough-shaping steps and a second for the refining steps.

The "surprising" effect is that in the newly-conceived multi-abrasive tool, the various abrasives with sequential roughness do not work in contrast with each other on the flat rough surfaces, but rather they work together in the achievement of the same result—which up to now had been attained by means of passages with different single-abrasive tools with decreasing grain size. A theoretical explanation of the phenomenon is not simple: a synergy has been verified between the different grains caused by the sequential nature of the grain size and the sequential nature of the operation during the movement of the tool on the surface to be polished or ground. An empirical explanation could hypothesize a kind of self-compensation between the contributions of the different abrasive elements due to the progressive height different between the scraping surfaces. For example, the larger grain elements which initially work more than the others in reducing the most significant roughness, will more greatly consume the abrasive support with respect to the adjacent elements, which will thus tend to maintain the larger grain abrasives more spaced from the average level of the surface. The same mechanism gradually operates for all the adjacent abrasive grains. In addition to that stated, as the finer grains work, the powders produced therefrom come to saturate the roughness present in the abrasives with larger grains, preventing them from affecting the already finely polished surfaces.

In accordance with a first embodiment of the invention, the tool has circular form or any regular polygonal form, i.e. equipped with rotational symmetry. The circular form is indicated for all types of polishing machines except those linear or merely orbital, i.e. where only rigid translations of the abrasive occur with respect to the surface to be polished. The arrangement of the abrasive elements on the (balanced) discoid support will have to ensure that the tool results dynamically balanced overall. This is possible in the following modes: a) by means of a symmetric distribution of abrasive mass, and non-abrasive mass, with respect to the center of the tool; b) by means of an asymmetric distribution of abrasive such that abrasive elements m1, m2—aligned along a diameter on opposite sides with respect to the center of the tool, whose centers of mass are at distance r1, r2, from the aforesaid center—generate equivalent contributions $m1 \cdot r1^2$, $m2 \cdot r2^2$ to the moment of inertia of the tool, and this is also valid for the regular polygonal forms of the tool.

In a first type of circular tool, the distance from the center of the tool increases or decreases from one abrasive element to the adjacent one depending on the clockwise or counterclockwise direction in which the sequence is followed. One embodiment in such sense is that in which the abrasive elements are concentric circular rings with sequential roughness, whether they are contiguous or arbitrarily spaced. In a similar tool, it is possible to increase the number of circular rings until a variable roughness is obtained that is nearly continuous in a radial direction. One variant is that in which the abrasive elements with sequential roughness partially occupy the same number of concentric circular rings, whether they are contiguous or arbitrarily spaced. In the tool of the variant, multiple abrasive elements of the same grain size are spaced within respective concentric circular rings. The mode of manufacture changes with respect to the preceding tool, but the advantages remain the same.

The tools manufactured as stated above are optimal for surfaces to be polished that are not delimited by walls, or in an entirely equivalent manner for the application to a polishing head of a bench polishing machine whose lateral movement can go beyond the edges of the surface to be polished. In the presence of side walls or equivalent constraints, the polishing cannot be optimal within a perimeter strip whose width depends on the overall dimensions on the edges of the head of the employed polishing machine and on the type of tool mounted. The (already mentioned) defect would be amplified by using the innovative tools with circular rings, since the sequential arrangement in merely radial direction of the concentric abrasive elements—even if the circular rings were narrow and affected a band in proximity to the peripheral edge—would in any case cause a gradual moving away of the abrasive of the same grain from the edge of the tool. Consequently, the abrasive would move away from the edge of the surface to be polished, which would progressively be without the effect of such grains.

The above defect is reduced by a different arrangement of the adjacent abrasive elements, like that of a second type of circular tool in which the abrasive elements with sequential roughness all have the same distance from the center of the tool, which signifies arranging the abrasive elements with sequential roughness along a circumference close to the peripheral edge of the circular tool itself. There remain the advantages consisting of the reduction of the polishing process steps, since the single tool completes a number of simultaneous steps corresponding with the number of the equipped different abrasive grains; there is also the advantage of the near-cancellation of the perimeter strip to be passed over, since all the grains can be used close to the edges.

A third type of circular tool synergistically combines the two aspects described above, by arranging the abrasive elements with sequential roughness along a section of a spiral path. The roughness of the abrasive tool therefore varies both radially and angularly with each abrasive element of the sequent. With respect to the merely radial arrangement of the abrasive elements, the further advantage that derives from this is to be able to mount wider abrasive elements without consequently increasing the width of the perimeter strip, gradually lacking the joint action of the abrasives. The width of such strip now only depends on the pitch of the spiral, which can be selected on the basis of the best results obtainable in the polishing of different materials. With respect to the merely angular, abrasive sequential nature, the addition of the radial component facilitates the synergy between the various grains, since the height difference between the same is enriched with such component. Such difference facilitates the self-compensation between the contributions to the polishing of the various abrasive elements. It is useful to observe, as the pitch of the spiral decreases, the third tool type will tend to converge into the second, where the abrasive elements with sequential roughness are arranged along a circumference.

In the third tool type, the polishing in proximity to the edges delimited by walls can be improved by arranging the abrasive elements to form two contiguous sequences with the same number of equally spaced elements, including a first sequence with roughness increasing from the periphery towards the interior and a second sequence with roughness decreasing from the periphery towards the interior. It can be appreciated that such arrangement allows all the grains to work close to the edges.

In accordance with a second embodiment of the invention, the abrasive tool works with translation along a straight line, in a continuous or alternating manner, and the adjacent abrasive elements in grain sequence occupy the oblique or orthogonal strips with respect to said straight line.

In accordance with a third embodiment of the invention that is particularly useful in grindstones, the abrasive tool has rotational symmetry, for example conical or cylindrical, and the abrasive surface is extended on the lateral surface within contiguous bands in grain sequence. The aforesaid bands can be annular or, especially in the tools associated with shank, with cylindrical helical form.

In accordance with a fourth embodiment of the invention, this too particularly useful in grindstones, the abrasive tool has spherical symmetry and the abrasive surface includes, in grain sequence, a spherical cap on the point followed by contiguous spherical zones.

The manufacture of the multi-grain tools according to the invention requires more time and more steps of deposition of the abrasives with respect to the conventional tools, but in substance it uses the same methods. The main difference consists of the selective fixing of the various grains to the substrate, which for each grain to be fixed requires a passage of masking the zones not affected by the current grain. The relative fixing, for example, can occur via electrostatic method, or by electrolytic drive with the aid of metals. After the deposit of that grain, there is the unmasking of the zone intended for the subsequent grain and the masking of the zone of the last deposited grain. The mass production will allow obtaining economies of scale, and it is not excluded that in the future more efficient manufacturing methods could be developed.

Advantages of the Invention

The advantages of the present invention have been fully illustrated in correspondence with the different achievement aspects of the same innovative idea; they can therefore be summarized by stating the following: with a greater achievement complexity of the abrasive tools, one obtains a reduction of the number of the same due to the greater complexity, and there remains a net benefit due to the increased speed of the entire polishing or grinding process, both for the net decrease of the number of passages and for the savings on the dead times due to the tool changes. By using the particular arrangements of the abrasive elements in the roughness sequences indicated, one also obtains an improvement in the polishing in proximity to the walls.

Finally, in the use of small manual tools for artistic or artisanal work, it is advantageous to be able to grind curved surfaces by each time selecting the part of the tool to be used.

BRIEF DESCRIPTION OF THE FIGURES

Further objects and advantages of the present invention will be clearer from the detailed description that follows of an embodiment of the same and from the enclosed drawings given as a merely non-limiting example, in which.

DETAILED DESCRIPTION OF SEVERAL PREFERRED EMBODIMENTS OF THE INVENTION

In the following description, equivalent elements which appear in different figures can be indicated with the same symbols. In the illustration of one figure, it is possible to make reference to elements not expressly indicated in that figure but in preceding figures. The scale and the proportions of the various depicted elements do not necessarily correspond with the actual scale and proportions.

Figure 17:
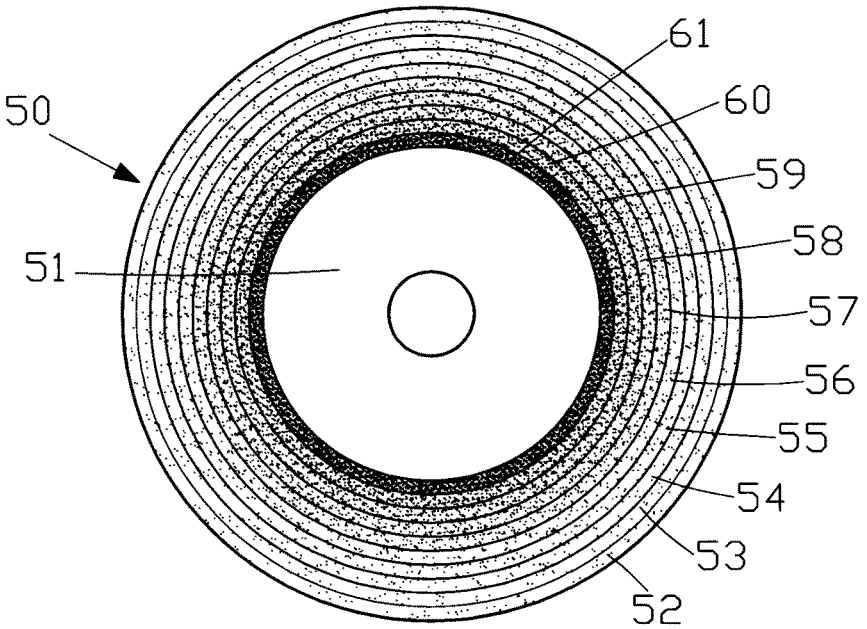
FIGS. 17-24 show the same number of discoid tools according to the present invention.

FIG. 17 shows an abrasive tool 50 constituted by a centrally-perforated discoid support 51, made of material suitable for the type of abrasive material employed and for the technique used for fixing the abrasive powder. If the tool 50 is a diamond tool, the support 51 could be, for example: brass, aluminum, resinoid material, vegetable or artificial fiber, etc. On the support 51, the abrasive powder, starting from the external edge, forms ten concentric circular rings 52-61 of equal width, contiguous to each other, made of different size grains. The finest grain is present on the outermost circular ring 52, the largest grain is present on the innermost circular grain 61, while on the other circular rings 53-60 the grain increases size, passing from a more external to a more internal circular ring. The number of circular rings, their width, as well as the size of the increase in abrasive grain size from one ring to the next, are all parameters which can be freely selected based on the materials to be polished and on the best experimental results. The abrasive tool 50 is dynamically balanced and is indicated for polishing flat or curved surfaces not surrounded by walls.

Figure 18:
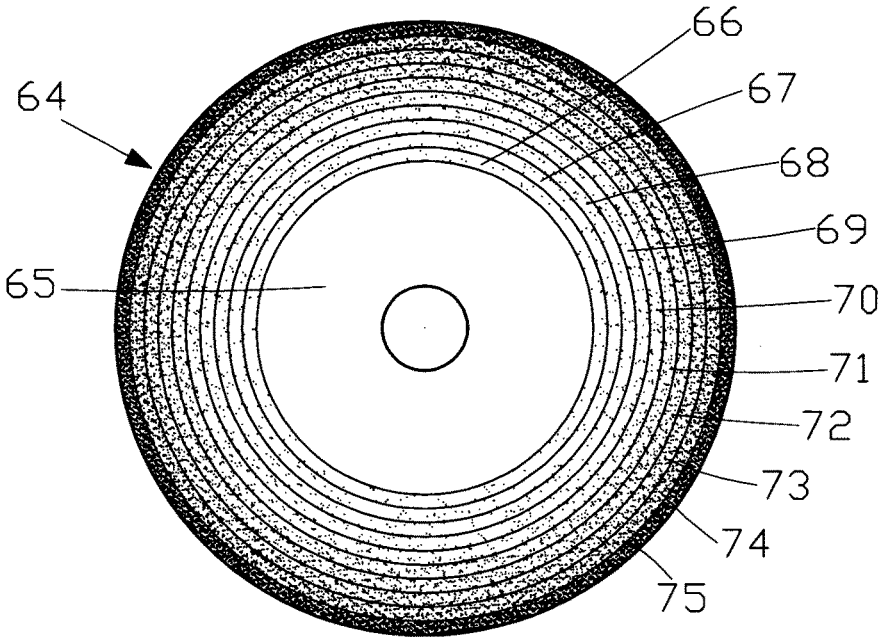

FIG. 18 shows a discoid abrasive tool 64 which differs from the tool 50 only for the fact that on the discoid support 65, the finest grain is present on the innermost circular ring 66, the largest grain is present on the outermost circular ring 75, while on the other circular rings 74-67 the grain decreases size, passing from a more external circular ring to a more internal one. The tools of the FIGS. 17 and 18 can be made with a minimum of two circular rings and a maximum which allows continuously varying the grain sizes.

Figure 19:
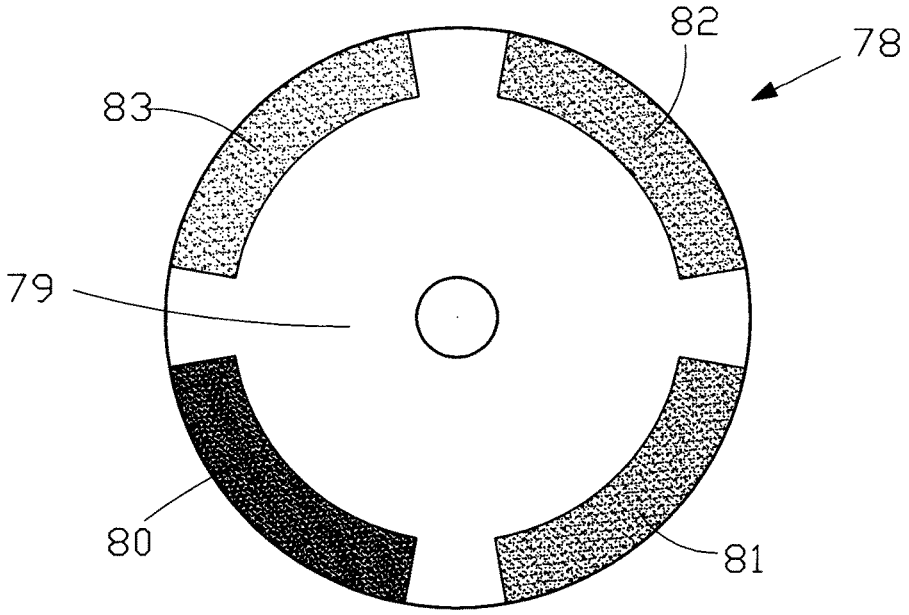

FIG. 19 shows a bottom view of an abrasive tool 78 constituted by a discoid support 79 perforated at the center, on whose work face four abrasive elements 80, 81, 82, 83 are present. Such elements are arranged along the external edge, and have the same geometric form, the same size, and different grain size ordered in sequence. The plan form is that of a circular ring sector 70° wide, the four sectors are mutually separated by a gap of 20° wide without abrasive. The form in the space of each abrasive element is obtained by extruding the flat form along a line orthogonal to the surface of the plate 79, in such a manner generating a thickness which is the same for all the abrasive elements. The depth in radial direction is arbitrary but equal for all the sectors, such to render the tool dynamically balanced. Starting from the abrasive element 80 with larger grain, the grain of the other abrasive elements decreases by an arbitrary quantity in passing from element to the next in counterclockwise direction. Starting instead from the abrasive element 83 with finest grain, the grain of the other abrasive elements increases by the same arbitrary quantity, passing from one element to the next in clockwise direction. The selection of clockwise or counterclockwise direction is arbitrary. The circular ring sector form is that capable of occupying most of the peripheral surface of the plate 97 with separate abrasive elements; it is not, however, binding in the obtainment of the tool and other forms—for example: circular sector, circle polygon, trapezoid, rectangle or other form—can utilize the same principle of sequential nature in the size of the various abrasive grains.

Figure 20:
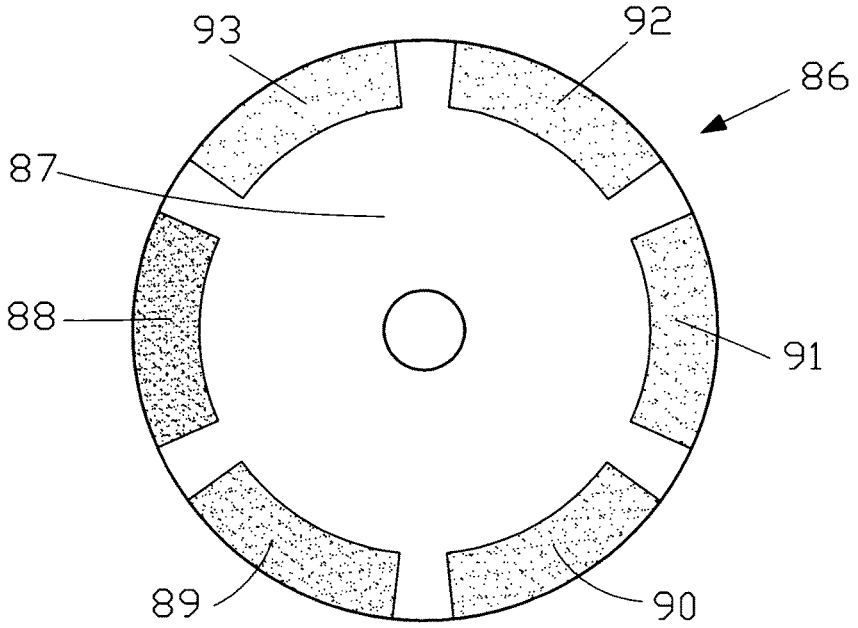

FIG. 20 shows an abrasive tool 86 which differs from the tool 78 due to the fact that on the external edge of the work surface of the discoid support 87, six abrasive elements are present in circular ring sector form 88, 89, 90, 91, 92, 93 with different grain size ordered in sequence, 48° wide and mutually separated by a space of 12° without abrasive. Starting from the abrasive element 88 with largest grain, the grain of the other abrasive elements decreases by an arbitrary quantity, passing from one element to the next in counterclockwise direction. The selection of the clockwise or counterclockwise selection is arbitrary. The grain of the abrasive element 88 with largest grain belonging to the tool 86 is of lower size than the grain of the abrasive element 83 with finest grain belonging to the tool 78 of FIG. 19. Considering the two tools 78 and 86 together, they provide an array of ten abrasive elements ordered in grain size sequence. With only two multi-abrasive tools, it is therefore possible to execute the entire polishing process of Table 1 which according to the prior art would require some ten single-abrasive tools. The following Table 2 summarizes the new process.

In the present description, the term "multi-abrasive" is referred to the plurality of abrasive grains of different size.

TABLE 2

Multi-abrasive tools for single-disc polishing machine

Figure 21:
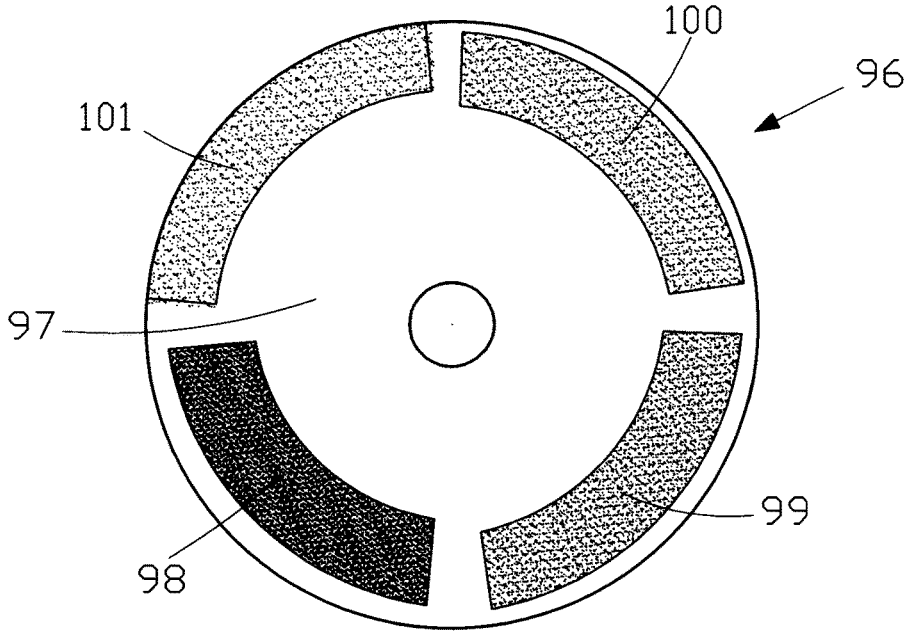
Figure 22:
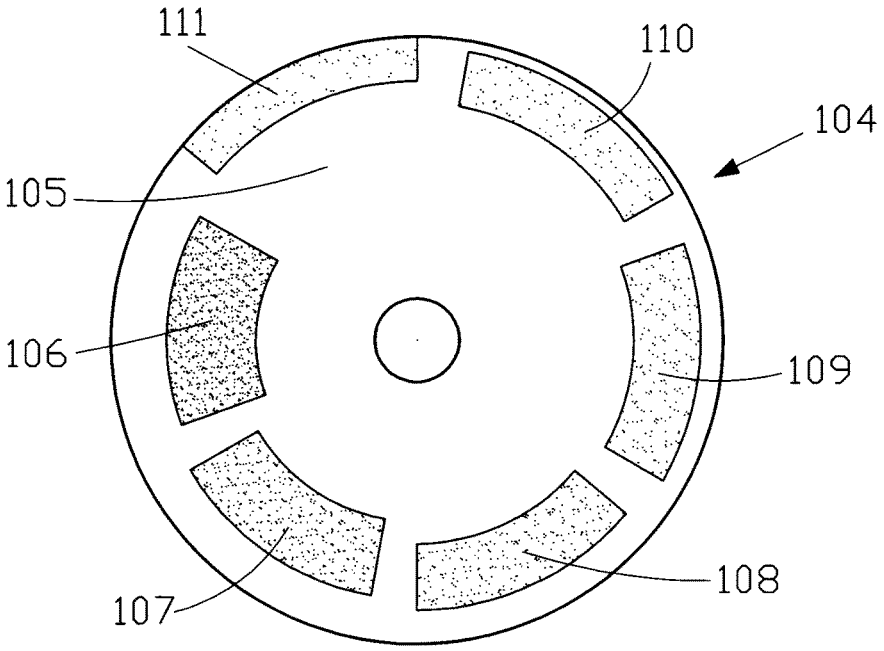

| Step No. | Correspondence with the steps of Table 1 | Step description | Type of tool | Type of Abrasive | Grain classification, Mesh ASTM - No |
|---|---|---|---|---|---|
| 1 | 1-2-3-4 | Rough-shaping | * Tool of FIGS. 19 or 21 | Diamond: two grains plus internal nickel binder; two grains plus external brass binder | 16-30-46-60 |
| 2 | 5-6-7-8-9-10 | Refining | ** Tool of FIGS. 20 or 22 | Diamond with resinoid binder | 120-220-400-800-1200-3500 |

In addition, having considered the arrangement of the abrasive elements, all adjoining the peripheral edge of the respective tools, the supplementary polishing in the perimeter strips surrounded by walls is reduced to a minimum if not actually non-existent. The tools of FIGS. 19 and 20 can be achieved with a minimum of two circular ring sectors, wide up to 180°.

FIGS. 21 and 22 show, in bottom view, a variant which adds a radial component in the abrasive grain size sequence to the tools of FIGS. 19 and 20. The grain size sequence of a circular tool according to the variant will thus have two geometric components: one angular and one radial. The abrasive elements of any preselected form will therefore have to be arranged along a spiral path, limited to the first turn or to a fraction thereof. By operating in such sense, in the presence of identical abrasive elements having circular ring shape, the diameter symmetry in the distribution of abrasive mass would necessarily be altered. It will then be necessary to suitably vary the size of the abrasive elements in order to restore the dynamic balance of the circular tool during rotation. With the lack of balance, the tool would trigger oscillations tending to alternately lift and lower a tool portion from the surface to be polished with respect to the diametrically opposed portion, comprising the process efficiency. The balancing requires the cancellation of the forces acting on the rotation axis; this can be obtained by equalizing the moments of inertia $m_i\ r_i^2$ of the single abrasive elements aligned along a diameter on opposite sides with respect to the center. Since the circular ring sector form of the abrasive elements remains in the new tool, in order to avoid overlaps the angular opening must decrease, passing from a more external abrasive element to a more internal one, this due to the progressive diminution of the curvature radius of the spiral. Thus, it will be necessary to vary the size in radial direction as well, in order to compensate both for the decrease of the angular opening, which reduces the mass, and the smaller distance from the center of the disc 97 which reduces the moment of inertia given the same mass. The abrasive elements will thus become less angularly extended and radially wider, in other words lower and broader as one moves away from the peripheral edge.

With reference to the bottom view of FIG. 21, an abrasive tool 96 is observed that is constituted by a discoid support 97 perforated at the center, on whose work face four abrasive elements 98, 99, 100, 101 are present; such elements are arranged in proximity to the external edge along a spiral path slightly less than a 360° spiral that starts on the edge. The abrasive elements have the same geometric form with circular ring sector, different size in radial and angular direction, and abrasive grains of different size arranged in size sequence. The form in the space is obtained by extruding the flat form along a line orthogonal to the surface of the plate 97, generating a thickness that is the same for all the abrasive elements so that they can simultaneous lie on the surface to be polished, at least in the initial working step. The pitch of the spiral is less than the width in radial direction (depth) of the abrasive element of lower depth 101, which borders on the edge of the plate 97. In such a manner, the area lacking abrasive contiguous to the circular edge is minimized, reducing therewith the width of the perimeter strip which requires a supplementary polishing. Starting from the abrasive element with larger grain 98, the grain of the other abrasive elements decreases by an arbitrary quantity in passing from one element to the next in counterclockwise direction. Starting instead from the abrasive element with finest grain 101, the grain of the other abrasive elements increases by the same arbitrary quantity in passing from one element to the next in clockwise direction. The selection of the clockwise or counterclockwise direction is arbitrary. With regard to the dynamic balancing, one considers for example the two abrasive elements 98 and 100 and one assumes to concentrate the mass of each of these in the respective barycenter, the barycentric masses and the respective distances from the center of the plate 97 are such that the following equation is verified: $m_{98}\ r_{98}^2 = m_{100}\ r_{100}^2$, and this is valid for all the pairs of abrasive elements, obtaining the balancing of the tool 96 therewith. The spaces lacking abrasive between one abrasive element and the adjacent element vary their width along the spiral path following the variation of the angular width of the same.

The addition of the radial component in the size sequence of the abrasive grains increases the efficiency of the multi-abrasive tool by decreasing the times required for polishing and improving the quality of the polished surfaces. Maximum efficiency was experimentally detected in the sequences where the larger grain abrasives are the more internal ones. With regard to the polishing in the perimeter strip against the wall, the configuration that arranges abrasive sectors of small area along the edge, in grain size succession, prevents the formation of an edge slightly raised towards the building wall. Such edge elevation would otherwise occur since the larger grain abrasive is the more internal one; in fact it results as close as possible to the edge of the plate, taking under consideration the fact that the part that works most in the abrasive sector is the external edge, the remaining part acting more as a support and only subsequently becoming relevant.

FIG. 22 shows an abrasive tool 104 which differs from the tool 96 for the fact that on the outer edge of the work face of the discoid support 105, six abrasive elements are present with circular ring sector form 106, 107, 108, 109, 110, 111 with different grain, size. Starting from the innermost abrasive element with largest grain 106, in the spiral path the grain of the other abrasive elements decreases by an arbitrary quantity, passing from one element to the next in counterclockwise direction. The selection of the clockwise or counterclockwise direction is arbitrary. The grain of the abrasive element with largest grain 106 of the tool 104 has lower size than the grain of the abrasive element with finest grain 101 of the tool 96 of FIG. 21. The arrangement and the size of the abrasive elements are such to make the tool 104 dynamically balanced. Considering the two tools 96 and 104 together, they provide a deployment of ten abrasive elements ordered in grain sequence like the tools 78 and 86 of FIGS. 19 and 20; therefore Table 2 is applicable without any modification to the pair of tools 96 and 104. The tools of FIGS. 21 and 22 can be made with a minimum of two circular ring sectors wide up to nearly 180° and sized in a manner so as to maintain the equality of the angular moment, according to the two following alternative modes: a) the sector furthest from the peripheral edge, slightly less wide than the first and slightly deeper; b) the sector furthest from the peripheral edge, slightly wider than the first and with equivalent depth.

Figure 23:
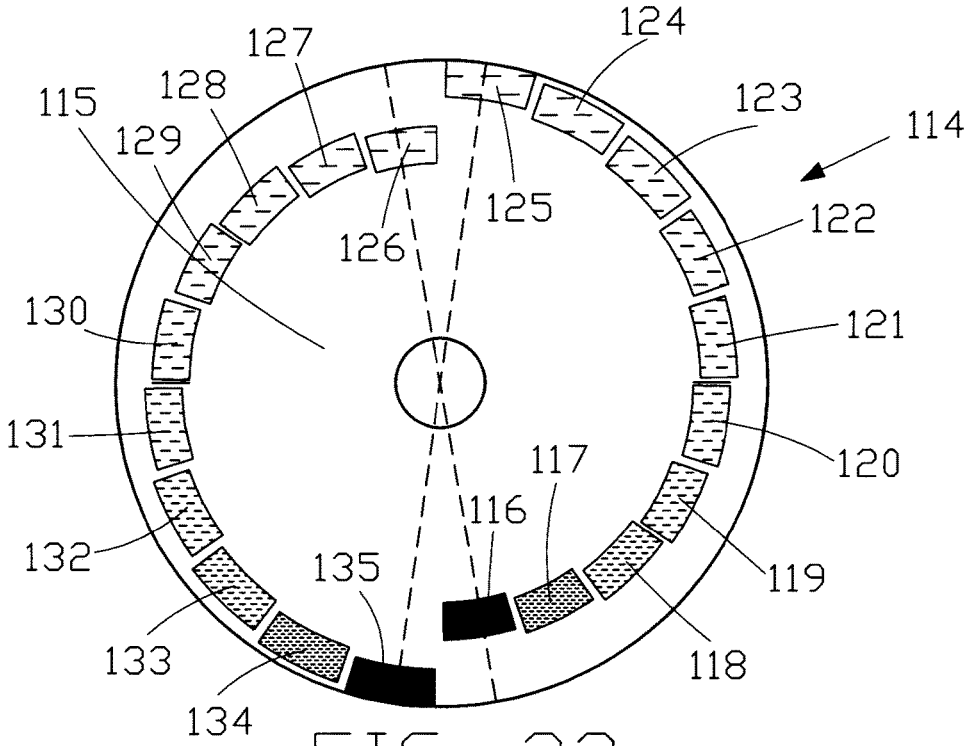
Figure 24:
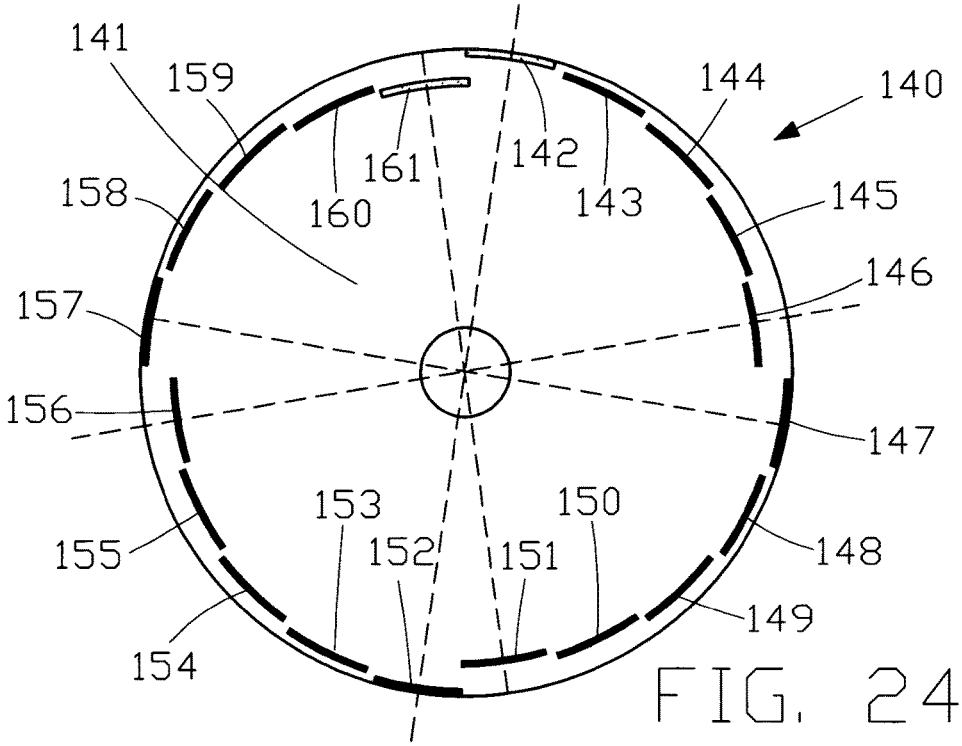

The subsequent FIGS. 23 and 24 show two abrasive tools which synthesize, and double, in a single tool the two abrasive tools 96 and 104 of the FIGS. 21 and 22, allowing the completion of the rough-shaping and the refining in Table 2 in a single step.

The bottom view of FIG. 23 shows an abrasive tool 114 constituted by a discoid support 115 perforated at the center, on whose work face 20 abrasive elements are present. Such elements are subdivided into two groups of ten, each occupying one half of the work face of the discoid support 115. The abrasive elements of a first group, indicated with 116, 117, 118, 119, 120, 121, 122, 123, 124, 125, are arranged in proximity to the external edge along a spiral path of 180°, corresponding with a half spiral with start on the edge. The abrasive elements of the second group, indicated with 126, 127, 128, 129, 130, 131, 132, 133, 134, 135, are also arranged in proximity to the external edge along another spiral path with half spiral length, which however does not continue from the preceding half spiral but restarts on the external edge from the end of the preceding half spiral.

The abrasive elements have the same geometric form with circular ring section, angular openings slightly different, the same depth in radial direction, and abrasive grains with different size arranged in sequence. Starting from the first group of ten abrasive elements, the element 125 with finest grain is that in contact with the peripheral edge of the plate 115, the grain of the other abrasive elements of the sequence increases by an arbitrary quantity, passing from one element to the next in clockwise direction until the innermost element 116 with largest grain is reached. Continuing in clockwise direction, the second group of ten abrasive elements continues, in which the element 135 with largest grain is that in contact with the peripheral edge of the plate 115, the grain of the other abrasive elements of the sequence decreases by an arbitrary quantity, passing from one element to the next in clockwise direction until the innermost element 116 with finest grain is reached. It can be appreciated in the figure that by varying the direction in the arrangement of all the abrasive grains, the configuration of the tool 114 does not vary, such variation in fact equates to a rigid half-turn rotation. It can also be appreciated that whatever the preselected rotation direction, the transition between the grains of the two groups occurs continuously. For an improved polishing, it is advantageous to maintain the same grain size values of the elements which occupy the same position in the respective sequence. The observation of the figure reveals two other interesting aspects. A first aspect regards an achievement simplification in attaining the dynamic balancing. The second aspect regards an advantage in polishing the perimeter strips. With regard to the first aspect, by observing the dashed-line diameters, one can observe that the elements of the same order in the two sequences are aligned along a common diameter at the same distance from the center of the plate 115 from opposite sides. This signifies that they have the same angular opening and thus must have the same size in radial direction. This holds true for all the corresponding element pairs, which suggests maintaining the radial size of all the abrasive elements unchanged. With regard to the second aspect, one can observe that, even for maintaining the sequential size variation of the ten grains in radial direction, it is necessary to more greatly space the abrasive elements from the edge of the plate 115 with respect to the tool 104 of FIG. 22; it is also true that the lack of polishing due to the gradual absence of abrasive along each sequence, is mainly recovered during a complete turn due to the radially offset arrangement of the abrasive elements with the same grain size. Indeed, the offset arrangement allows abrasives of the same grain to complete two parallel circumferences in the perimeter strip.

The bottom view of FIG. 24 shows an abrasive tool 140 constituted by a discoid support 141 perforated at the center, on whose work face twenty abrasive elements are presented, subdivided into four groups of five that are contiguous to each other. The abrasive elements of each group of five elements are arranged along a 90° spiral path corresponding to a quarter of spire, each time beginning from the external edge of the plate 141. The four groups are in turn grouped two-by-two to form two super-groups, each composed of ten abrasive elements ordered by sequential size of the grains. Each super-group occupies half of the work face of the discoid support 141. The abrasive elements of a first super-group are indicated with: 142, 143, 144, 145, 146, 147, 148, 149, 150, 151. The abrasive elements of the second super-group are indicated with: 152, 153, 154, 155, 156, 157, 158, 159, 160, 161. The abrasive elements have the same geometric shape with circular ring sector, the same angular opening, the same depth in radial direction and, as said, abrasive grains of different size that are sequentially ordered. Unlike the tool 114, the external margin of each abrasive element is placed on a circumference of radius lower or equal to that of the circumference on which the innermost edge lies of the more external adjacent abrasive element. With such arrangement, the abrasive elements are radially as well as angularly separated. Of course, the elements must have a width in radial direction that is less than that of the elements of the tool 114 in order to avoid an excessive enlargement of the peripheral zone lacking abrasive; it is for this reason that the super-group of ten was subdivided into two groups of five, each starting from the peripheral edge of the plate 141. In the first super-group of ten abrasive elements, the element 142 with finest grain is in contact with the peripheral edge of the plate 141, like the sixth element 147 with intermediate grain; starting from the element 141, the grain of the subsequent abrasive elements of the sequence of ten increases by an arbitrary quantity in passing from one element to the next in clockwise direction, until the largest grain element 151 is reached. Continuing in clockwise direction, the second super-group of ten abrasive elements continues, in which the element 152 with largest grain and the sixth element 157 with intermediate grain are in contact with the peripheral edge of the plate 115, the grain of the other abrasive elements of the sequence decreases in passing from one element to the next in clockwise direction until the finest grain element 161 is reached. The clockwise or counterclockwise direction in the arrangement of the abrasive elements is entirely arbitrary. The considerations on the balancing and the advantages obtainable with the tool 140 coincide with that stated regarding the tool 114 of FIG. 23. The smaller width in radial direction of the abrasive elements does not appear to negatively affect the operating duration of the tool 140 in a significant manner, since (as stated) the abrasive elements mainly work on the external edge.

The subsequent FIGS. 25, 26, 27, 28, 29 are aimed to illustrate the abrasive tools achieved according to the dictates of the present invention, obtained by adapting in an "artisanal" manner the plates of the polishing machines and the abrasive components easily found on the market. Structurally, such new tools are simpler to obtain than those described in the preceding FIGS. 17 to 24, since they do not require an ad-hoc design of the abrasive elements; on the other hand, the polishing process which uses ten decreasing sizes of abrasive grains requires more than the two abrasive tools indicated in Table 2, but in any case less than the ten tools listed in Table 1. The considerations made on the balancing are also hold true for the plates of the polishing machines which mount the tools of the configurations shown in FIGS. 25 to 29, provided that said tools are anchored in a symmetric manner with respect to the center of the plate that hosts them.

Figure 25:
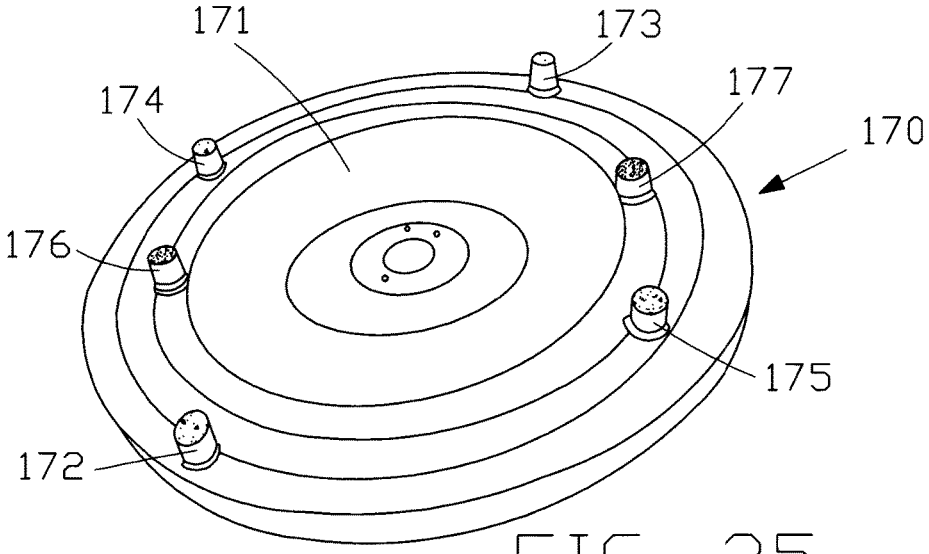
FIG. 25 shows a perspective view of a backing pad on which cylindrical abrasive tools are mounted, arranged according to the invention.

The perspective view of FIG. 25 shows a tool 170 comprising a circular plate 171 on which six abrasive elements 172, 173, 174, 175, 176, 177 are fixed, having the form of small cylinders, spaced 60° from each other and arranged two-by-two on concentric circles. The fixing to the plate 171 can be one of the following types: Velcro, glue, or fitting in suitable grooves or cavities. The six small cylinders form three groups of three different grain sizes; each group includes two elements of the same abrasive grain size. The abrasive small cylinders of each group are aligned along a common diameter on opposite sides with respect to the center of the plate 171 at the same distance therefrom. The distances from the center vary from one group to the other, such that it is possible to identify a first group whose two small cylinders are at greater distance from the center; a second group in which they are at intermediate distance; and a third group in which they are at the smallest distance. The difference in the distances from the center of adjacent group elements is greater than or equal to the diameter of the base of the abrasive small cylinders, which thus result radially separated. The three groups are ordered in abrasive grain size sequence. More specifically, a first group comprises the outermost small cylinders 172, 173 with finest grain, placed in proximity to the external edge of the plate 171; a second adjacent group comprises the small cylinders 174, 175 with intermediate grain size; and finally a third adjacent group comprises the cylinders 176, 177 with largest grain size. The following design parameters can be arbitrarily changed without limiting the invention: the number of abrasive small cylinder groups; the number of small cylinders per group; the distance in radial direction between the elements of adjacent groups; the increasing or decreasing grain size sequence in radial direction; the size of the initial grain and the extent of the single grain variation steps. The polishing process of Table 1 can be made quicker and more efficient by using abrasive tools of type 170. It is possible, for example, to complete the rough-shaping with two tools of type 170, equipped with only two small cylinder groups, and the subsequent refining with two tools 170 like that shown in the figure. The tool 170 can be mounted on any type of polishing machine which includes a rotation in its movement.

Figure 15:
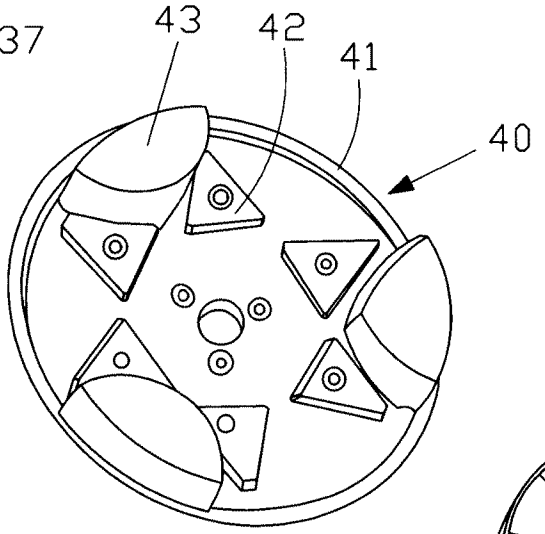
Figure 16:
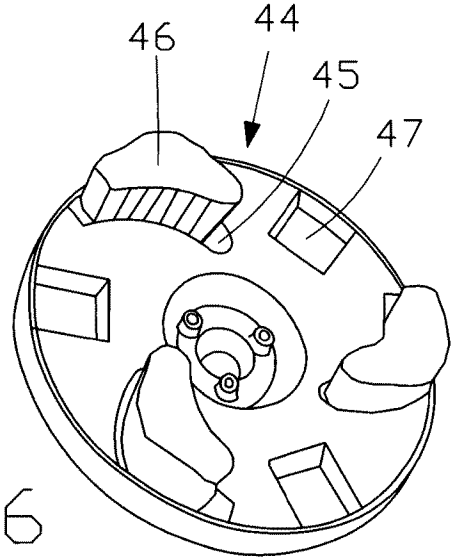
Figure 26:
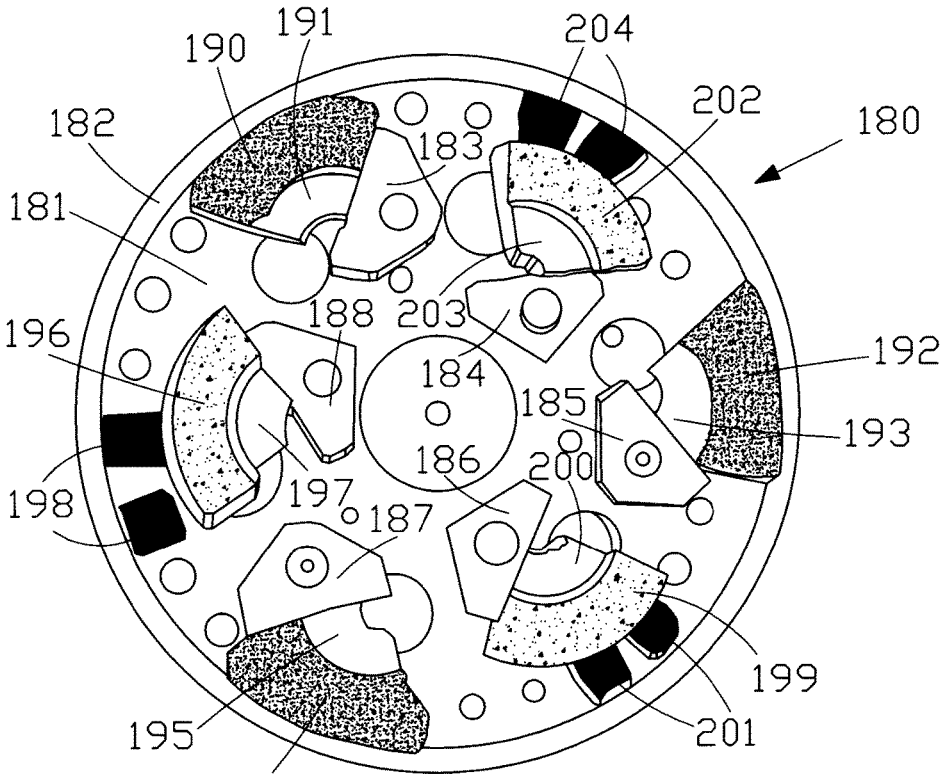
FIG. 26 is a bottom view of the rotary plate of a single-disc polishing machine on which the cylindrical abrasive tools are mounted, arranged according to the invention.

The bottom view of FIG. 26 shows a polishing configuration 180 constructed on the circular plate 181 of a single-disc polishing machine. The plate 181 has a peripheral edge 182 projecting orthogonally beyond the surface of the face on which six trapezoidal reliefs 183, 184, 185, 186, 187, 188 are anchored. Such reliefs are arranged in a circle around a central hole in order to lock six respective abrasive sectors against the edge 182, as stated for the Cassani abrasive sectors of FIG. 15. In the bottom view, each abrasive sector has the form of a mixtilinear trapezoid or more suitably of a circular ring sector. In spatial view, each sector is composed of a non-abrasive support, e.g. magnesic, from which the actual diamond abrasive element extends upward, occupying the portion comprised between the outermost edge of the second up to over half the width in radial direction. With reference to FIG. 26, one can observe three abrasive sectors 190, 192, 194, of equivalent grain size, spaced from each other by 120°, and maintained against edge 182 by the pressure exerted by the respective trapezoidal reliefs 183, 185, 187 against the magnesic supports 191, 193, 195 belonging to the respective abrasive sectors. Another three abrasive sectors 196, 199, 202 mutually spaced by 120°, with equivalent grain size, greater than the grain size of the preceding abrasive elements, are interposed with the three abrasive sectors 190, 192, 194, in receded position with respect to the circular edge 182. The three receded abrasive sectors are arranged along a circumference and maintained fixed on the plate 182 by the pressure jointly exercised by the respective trapezoidal reliefs 188, 186, 184 against the supports 197, 200, 203 belonging to respective sectors, and by pairs of spacers 198, 201, 204 placed between the external edge of the abrasive sectors 196, 199, 202 and the peripheral circular edge with relief 182 of the plate 181. In conclusion, the abrasive elements project from the edge 182 by a section of equivalent height. The spacers 198, 201, 204 maintain the abrasive sectors at an arbitrary distance from the edge 182, in particular greater than or equal to the width of the adjacent abrasive sectors so to be radially in addition to angularly separated with grain succession. The polishing process of Table 1 can be made quicker and more efficient by using the configuration of the plate 180; indeed, it is possible to halve the number of steps and tools. Based on the diameter of the plate 181 and the size of the used abrasive sectors, it is possible (according to the same scheme) to mount sectors having more than two abrasive grains.

The abrasive configuration of FIG. 26 can be achieved with a minimum of two abrasive sectors wider than those shown in the figure, sized so as to maintain the equality of the angular moment.

Figure 1:
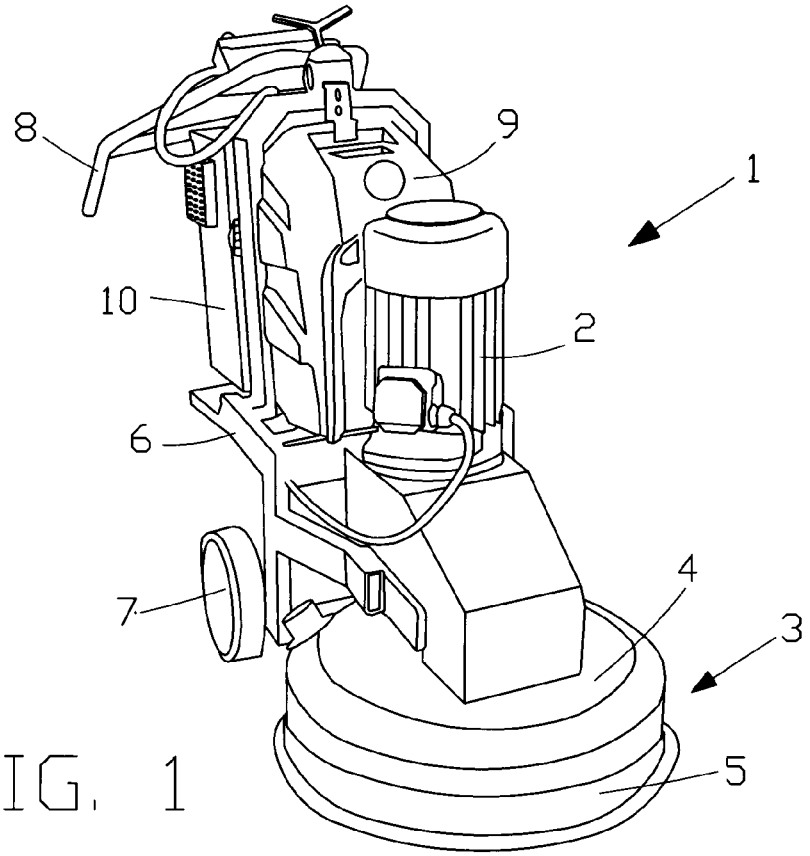
FIG. 1 is a perspective view of a typical portable polishing machine of planetary type.
Figure 2:
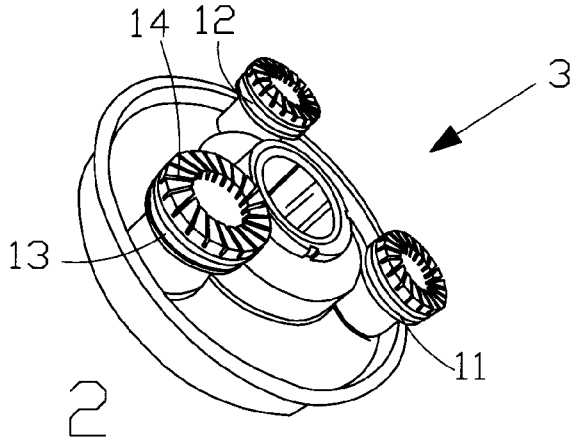
FIG. 2 is a bottom perspective view of the head of the planet comprised in the polishing machine of FIG. 1.
Figure 3:
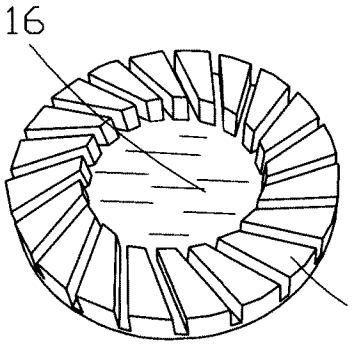
FIGS. 3-8 show a subset of abrasive tools belonging to the prior art used in the planetary head shown in FIG. 2.
Figure 4:
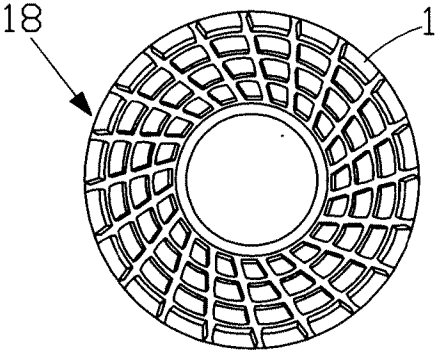
Figure 5:
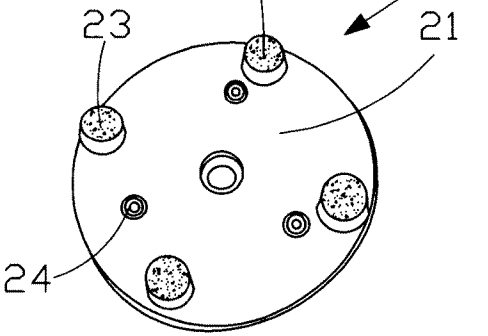
Figure 6:
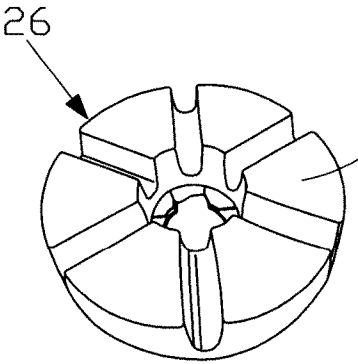
Figure 7:
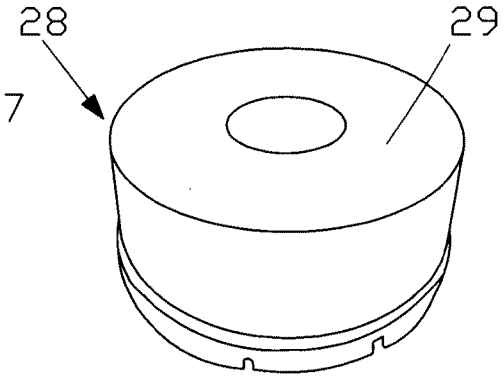
Figure 8:
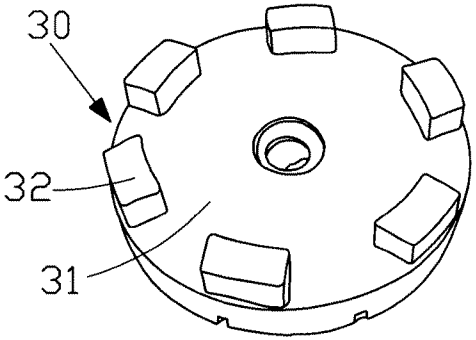
Figure 11:
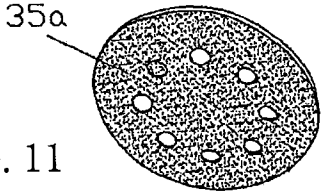
FIGS. 11, 12, 13 show three flexible abrasive discs each one having an its own grain size, and the three grains with decreasing size, fixable to the backing plate of FIG. 9.
Figure 12:
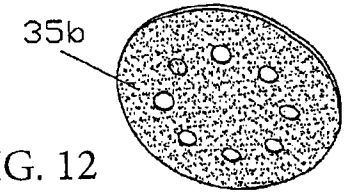
Figure 13:
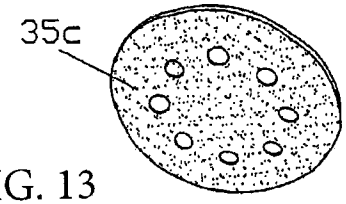
Figure 10:
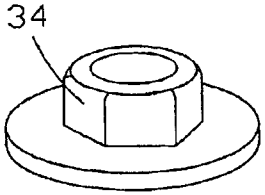
FIGS. 9 and 10 show the two faces of a backing pad fixable to the rotary plate of a single-disc polishing machine as intermediate support for abrasive elements of various shape.
Figure 9:
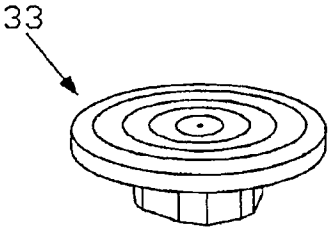
Figure 14:
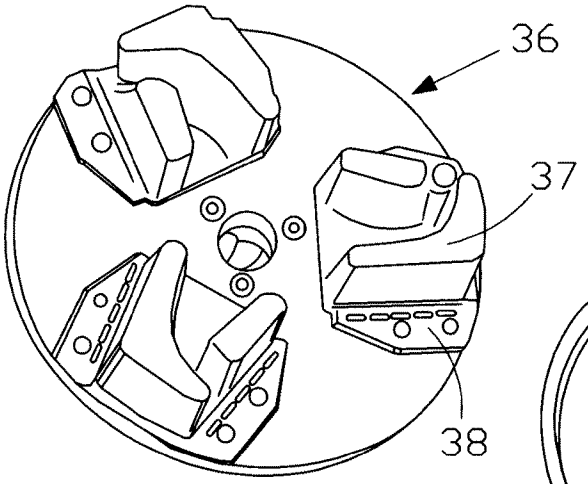
FIGS. 14, 15, 16 are perspective views of abrasive tools of the prior art comprising abrasive elements mounted on the rotary plate of a single-disc polishing machine.
Figure 27:
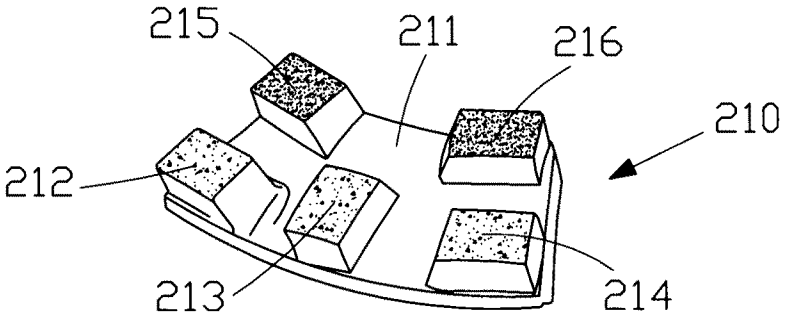
FIGS. 27, 28, 29 show a perspective views of other configurations of abrasive tools according to the invention that can be mounted on the plate of FIG. 26.

FIG. 27 shows a perspective view of an abrasive tool 210 constituted by a support 211 with circular ring sector form from which two parallel rows of parallelepiped abrasive blocks project; such blocks have the same thickness and different grain size. The outermost row comprises three diamond abrasive blocks 212, 213, 214, arranged along the external edge; the innermost row comprises two diamond abrasive blocks 215, 216 arranged along the inner edge. The abrasive grain of the blocks 215, 216 has greater grain size than the grain of the blocks 212, 213, 214. The tool 210 can be considered a variant according to the invention of an abrasive sector of Cassani type of FIG. 15, or a variant according to the invention of a fraction of the diamond resinoid disc of FIG. 8.

Figure 28:
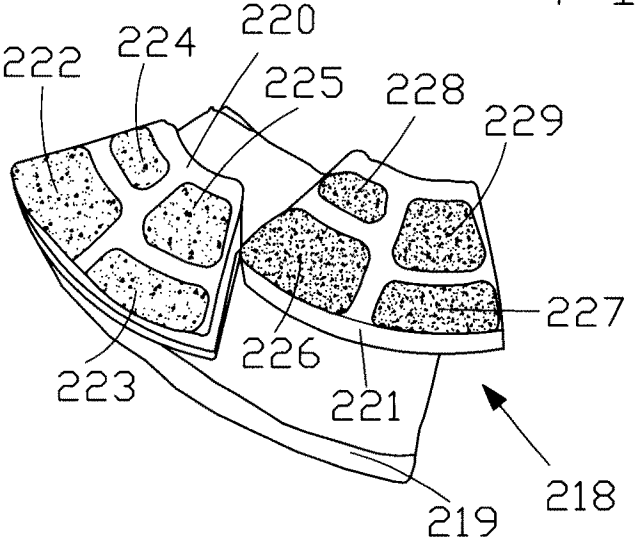

FIG. 28 shows a perspective view of an abrasive tool 218 constituted by a support 219 with circular ring sector form, on which two abrasive sectors 220 and 221 are glued, having circular ring sector form of equivalent size. The abrasive sector 220 is flush with the external edge of the support 219 astride one side, while the sector 221 is more receded with respect to the 220 and is extended on the support 219 beyond the other side and beyond the lower edge. The abrasive sector 220 is constituted by a support on which four abrasive elements 222, 223, 224, 225 are glued; such elements are pseudo-parallelepiped, with reduced thickness and different size, and are arranged on two parallel rows. The abrasive elements 222 and 223 border the external edge of their own sector while the elements 224 and 225 border the internal edge. The abrasive sector 221 is constituted by a support on which four abrasive elements 226, 227, 228, 229 are glued, arranged on two parallel rows. The latter elements are pseudo-parallelepiped, with reduced thickness, with different size and with greater grain size than that of the preceding abrasive elements. The abrasive tool 218 can be advantageously mounted on a plate of a single-disc polishing machine by utilizing the suitable reliefs. In the structure of the abrasive configuration, for example on plate 181 of FIG. 26, each abrasive sector 220 and 221 must be considered as a unique abrasive element, such that the sequential nature of the grain size has two values, both in radial and circumferential direction. The set of the two sectors comes to resemble two adjacent sectors of the configuration 180 of FIG. 26 brought close to each other to the point of being contiguous.

Figure 29:
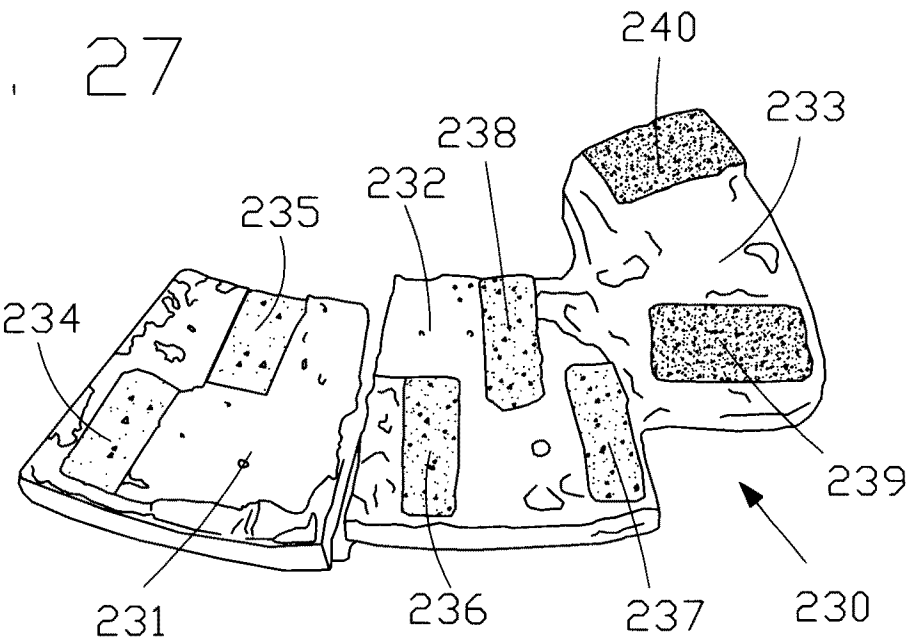

FIG. 29 shows a perspective view of an abrasive tool 230 constituted by three contiguous abrasive supports 231, 232, 233, having a shape which resembles a long/broad circular ring sector or a mixtilinear trapezoid. The three adjacent supports gradually recede from a subsequent support. The supports 231 and 232 are glued along one side; the support 233 is rotated 90° and has the inner edge glued to the other side of the support 232. The abrasive support 231 includes two abrasive elements 234, 235 that are pseudo-parallelepiped and have reduced thickness. The abrasive support 232 includes three abrasive elements 236, 237, 238, pseudo-parallelepiped and with reduced thickness, whose grain is greater than that of the preceding abrasive elements. The abrasive support 233 includes two abrasive elements 239 and 240, pseudo-parallelepiped and with reduced thickness, whose grain is greater than that of the preceding abrasive elements. All the parallelepiped abrasive elements have a short side bordering a curvilinear edge of its own support. The element 234 borders the external edge of their own support, while the element 235 borders the internal edge. The two elements are not aligned. The elements 236 and 237 border the external edge of their own support, while the element 238 borders the internal edge and is not aligned with the two preceding elements. The elements 239 and 240 border both the edges of their own sector. The abrasive tool 230 can be advantageously mounted on the plate of a single-disc polishing machine by utilizing the suitable reliefs. Also in this case, each abrasive sector can be considered as a single abrasive element, such that the sequential nature of the grain size has three values, both in radial and circumferential direction.

Figure 30:
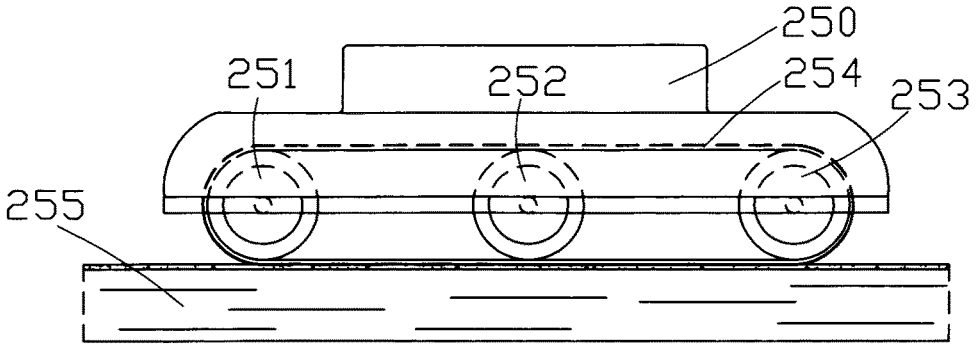
FIG. 30 shows an elevation view of a linear polishing machine which mounts an abrasive belt made according to the present invention.
Figure 31:
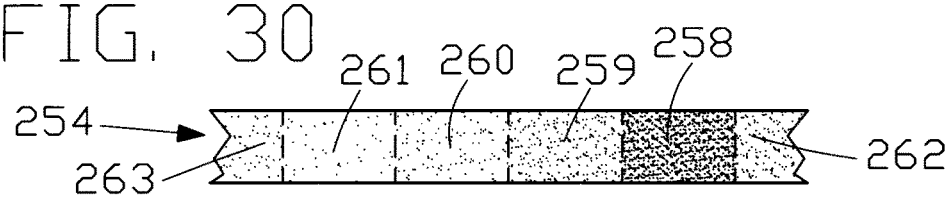
FIG. 31 shows a bottom view of a section of the abrasive belt mounted on the polishing machine of FIG. 30.

FIG. 30 shows a belt polishing machine 250 whose electric motors rotates an abrasive belt 254 wound on an assembly of three parallel rollers 251, 252, 253, maintained by the weight of the polishing machine against a sheet 255 to be polished. An abrasive belt section 254 is shown in FIG. 31, where one can observe that the abrasive surface is constituted by a repetitive sequence in longitudinal direction of four rectangular abrasive zones: 258, 259, 260, 261, having abrasive grain size decreasing by an arbitrary quantity in passing from one zone to the next. So as to avoid sudden discontinuities in the grain size when passing from one sequence to the next, or to the preceding, the grain size order is reversed in the adjacent sequences to the right and left, in a manner such that the zone with finest grain 261 has to its left a zone 263 with the same size as the preceding zone 260, and similarly the zone with largest grain 258 has to its right a zone 262 whose grain has the same size as the subsequent zone 259. Compatibly with the length of the belt 254, the number of abrasive zones, with a minimum of two, and their length are arbitrary parameters. The abrasive zone could also be oblique.

Figure 32:
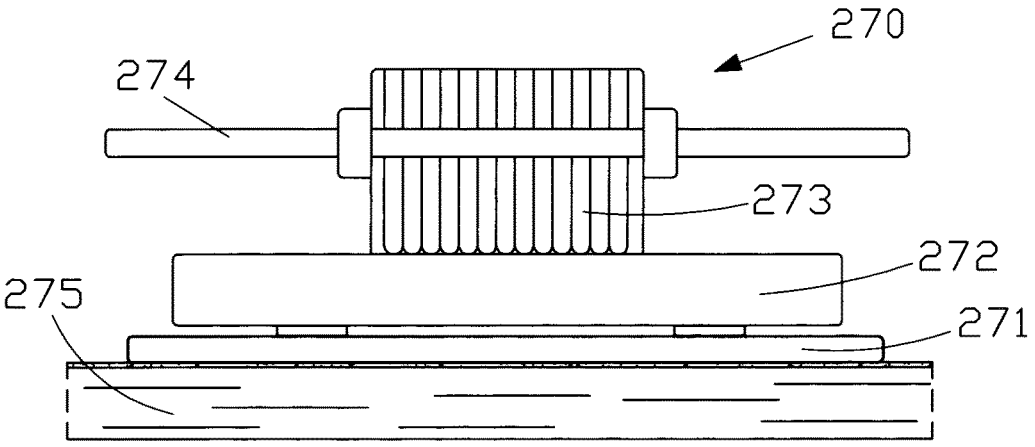
FIG. 32 is an elevation view of an orbital polishing machine or alternative which mounts an abrasive plate made according to the present invention.
Figure 33:
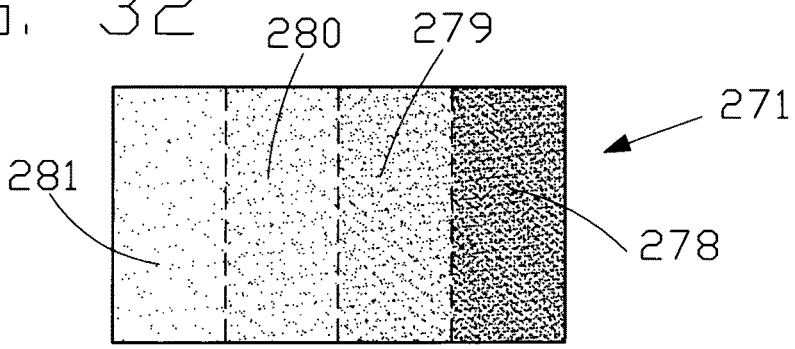
FIG. 33 shows a bottom view of the abrasive plate mounted on the polishing machine of FIG. 32.

FIG. 32 shows an orbital polishing machine 270 of manual type, or of alternative rectilinear type on which an abrasive plate 271 is mounted, such plate moved by a mechanism 272 driven by an electric motor 273. A handle 274 is gripped by the operator in order to maneuver the plate 271 on a sheet 275 to be polished. With reference to FIG. 33, it can be observed that the rectangular plate 271 comprises in longitudinal direction a sequence of four rectangular abrasive zones: 278, 279, 280, 281, having abrasive grain size decreasing by an arbitrary amount in passing from one zone to the next. Compatibly with the length of the plate 271, the number of abrasive zones, with a minimum of two, and their width are arbitrary parameters. The abrasive zones can also be oblique.

Figure 34:
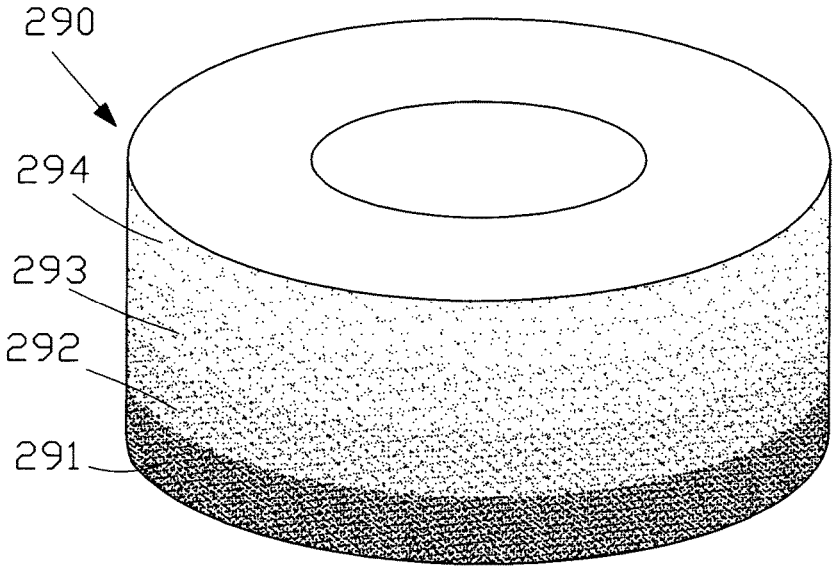
FIG. 34 is a perspective view of a bench grinding tool with cylindrical shape made according to the present invention.
Figure 36:
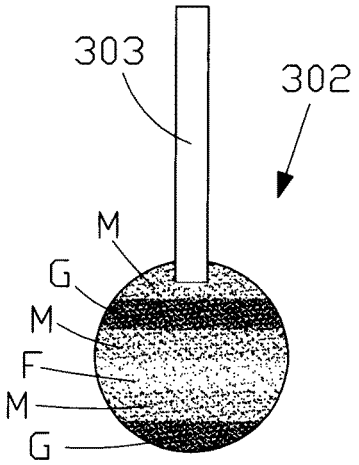
FIG. 36 is a front view of a bench grinding tool of spherical shape obtained according to the present invention.
Figure 35:
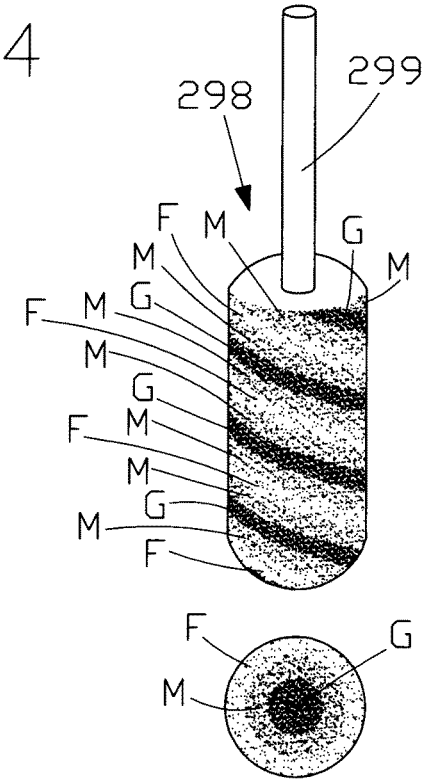
FIG. 35 is a perspective view of a bench grinding tool with cylindrical shape according to the present invention, including a bottom view of the rounded tip.

The subsequent FIGS. 34, 35, 36 show the multi-grain abrasive tools particularly suitable for use in grindstones.

FIG. 34 shows a cylindrical abrasive tool 290 perforated at its center, whose lateral surface supports four abrasive annular zones contiguous with each other, respectively 291, 292, 293, 294, in a grain size sequence starting from the largest grain of zone 291 adjacent to the base. The order of the sequence can be overturned and the number of the annular bands changed as required. The tool 290 is particularly suitable for use in bench grindstones.

FIG. 35 shows a cylindrical abrasive tool 298 with rounded tip, equipped with a shank 299 for fixing to the flexible grinding wheel of a grindstone. The tip seen from below is shown in the figure. The cylindrical surface supports an alternation of contiguous bands of helical form having abrasive grains with three different sizes indicated with the letters F (fine), M (medium), and G (large). Each helical band is wound along the entire lateral surface. The tip supports three sequential abrasive spherical zones with grains F, M, G. One can appreciate in the figure that the transition from one grain size to the next occurs with the smallest allowed variation.

FIG. 36 shows an abrasive tool 302 of spherical form, equipped with a shank 303 for fixing to the flexible grinding wheel of a grindstone. The spherical surface supports an alternation of contiguous bands, of which the part opposite the shank is a spherical cap and the other parts are spherical zones. The bands have the three grains G, M, F starting from the cap and they continue with a soft transition.

On the basis of the description provided for a preferred embodiment, it is obvious that some changes can be introduced by the man skilled in the art, without departing from the scope of the invention as results from the following claims.

The invention claimed is:

1. An abrasive tool, comprising:

a work face; and at least a first abrasive element, a second abrasive element adjacent to the first abrasive element, and a next abrasive element adjacent to the second abrasive element, the first, second, and next abrasive elements being located on the work face, wherein the first abrasive element has a first roughness value, the second abrasive element has a second roughness value different from the first roughness value, and the next abrasive element has a next roughness value different from the first and second roughness values, the first, second, and next roughness values being homogeneous across the first, second, and next abrasive elements, respectively, and the first, second, and next abrasive elements being arranged in a manner so as to form, along at least one path between the first, second, and next abrasive elements, a sequence that is ordered by increasing or decreasing roughness values, wherein the abrasive tool has a circular shape or any one regular polygonal shape, the arrangement of said abrasive tool involving a distribution of abrasive mass with respect to the center of the tool such that abrasive elements whose center of mass are aligned on opposite sides with respect to the center of the tool, at respective equal distances from the center of the tool, generate equivalent contributions to the moment of inertia of the tool, and wherein the first, second, and next abrasive elements are disposed substantially in a spiral pattern relative to the center of the tool, such that the distance of the second abrasive element from the center of the tool is different from the distance of the first abrasive element from the center of the tool, and the distance of the next abrasive element from the center of the tool is different from the distances of the first and second abrasive elements from the center of the tool, such that distance from the center of the tool increases or decreases from one abrasive element to the adjacent one, depending on whether the sequence follows a clockwise or a counter-clockwise direction.

2. The abrasive tool of claim 1, wherein the grain size of the abrasive elements varies nearly continuously in a radial direction.

3. The abrasive tool of claim 1, wherein said abrasive elements are arranged along a spiral path of about 360° starting from the peripheral edge of the tool.

4. The abrasive tool of claim 1, wherein abrasive elements belonging to groups of equal number are spaced along two or more spiral paths with equivalent angular opening, submultiple of 360°, and starting from the peripheral edge of the tool.

5. The abrasive tool of claim 1, wherein the abrasive tool is obtained directly on the plate of a polishing machine by means of reliefs arranged in a circle in order to anchor the abrasive elements under pressure against the projecting peripheral edge, both directly and by means of spacers.

* * * * *